US011084041B2

(12) United States Patent
Tsai et al.

(10) Patent No.: US 11,084,041 B2
(45) Date of Patent: Aug. 10, 2021

(54) PAPER SHREDDER WITH PAPER LIMITER

(71) Applicant: Aurora Office Equipment Co., Ltd. Shanghai, Shanghai (CN)

(72) Inventors: Chung Shih Tsai, Hawthorne, CA (US); Er Ren Zhong, Shanghai (CN); Guanglong Chen, Shanghai (CN); Tao Kuei Chuang, Shanghai (CN)

(73) Assignee: Aurora Office Equipment Co., Ltd. Shanghai, Shanghai (CN)

( * ) Notice: Subject to any disclaimer, the term of this patent is extended or adjusted under 35 U.S.C. 154(b) by 113 days.

(21) Appl. No.: 16/576,711

(22) Filed: Sep. 19, 2019

(65) Prior Publication Data

US 2021/0086190 A1 Mar. 25, 2021

(51) Int. Cl.

| | |
|---|---|
| ***B02C 18/00*** | (2006.01) |
| ***B02C 18/22*** | (2006.01) |
| *B02C 18/16* | (2006.01) |

(52) U.S. Cl.

CPC ..... *B02C 18/0007* (2013.01); *B02C 18/2283* (2013.01); *B02C 2018/0038* (2013.01); *B02C 2018/164* (2013.01)

(58) Field of Classification Search

CPC ..... B02C 18/0007; B02C 18/2283

See application file for complete search history.

(56) References Cited

U.S. PATENT DOCUMENTS

| | | | | |
|---|---|---|---|---|
| 4,817,877 | A * | 4/1989 | Itoh | B02C 18/0007 241/225 |
| 4,842,205 | A * | 6/1989 | Araki | B02C 18/0007 241/225 |
| 4,957,243 | A * | 9/1990 | Kanagaki | B02C 18/0007 241/236 |
| 5,362,002 | A * | 11/1994 | Tsai | B02C 18/2225 241/222 |
| 5,772,129 | A * | 6/1998 | Nishio | B02C 18/0007 241/30 |
| 5,884,855 | A * | 3/1999 | Chang | B02C 18/0007 241/34 |
| 6,390,397 | B1 * | 5/2002 | Ko | B02C 18/0007 241/100 |
| 7,828,235 | B2 * | 11/2010 | Matlin | B02C 18/0007 241/34 |
| 8,167,223 | B2 * | 5/2012 | Jensen | B02C 18/2216 241/34 |

(Continued)

*Primary Examiner* — Faye Francis

(74) *Attorney, Agent, or Firm* — WHGC, P.L.C.; John F. O'Rourke; Alexander R. Schlee

(57) ABSTRACT

A paper shredder has a paper tray, a paper inlet, a shredder cover, a paper pressing plate, paper pick-up rollers, a shredder cutter shaft, a motor, a wastepaper barrel, and a paper limiter. The paper tray carries a stack of to-be-shredded paper. The paper inlet guides to-be-shredded paper. The shredder cover end is connected to the shredder body by a rotary shaft, closing or opening the shredder body. The paper pressing pl presses the stack in the paper tray. The paper pick-up rollers are on one side of the paper inlet, feeding the paper tray stack into the paper inlet. The shredder cutter shaft shreds the to-be-shredded paper. The motor drives the shredder cutter shaft to operate. The wastepaper barrel is located below the paper inlet to collect shredded paper. The paper limiter is limits one of a thickness or a length of the stack placed in the paper tray.

18 Claims, 11 Drawing Sheets

(56) References Cited

U.S. PATENT DOCUMENTS

| | | | | |
|---|---|---|---|---|
| 8,998,119 | B2 * | 4/2015 | Zhan | B02C 18/2283 241/34 |
| 9,186,678 | B2 * | 11/2015 | Xu | B02C 23/00 |
| 9,669,411 | B2 * | 6/2017 | Matlin | B65H 1/04 |
| 10,124,344 | B2 * | 11/2018 | Xu | B02C 18/2241 |
| 2005/0133648 | A1 * | 6/2005 | Horiuchi | B65H 29/12 241/236 |
| 2010/0032507 | A1 * | 2/2010 | Chen | B02C 18/2291 241/34 |
| 2011/0049277 | A1 * | 3/2011 | Matlin | B02C 18/2283 241/30 |
| 2011/0303775 | A1 * | 12/2011 | Kim | B02C 18/0007 241/34 |
| 2012/0018554 | A1 * | 1/2012 | Seo | B02C 18/0007 241/101.2 |
| 2014/0042254 | A1 * | 2/2014 | Zhan | B02C 18/0007 241/34 |
| 2014/0103151 | A1 * | 4/2014 | Xu | B02C 18/0007 241/28 |
| 2015/0090818 | A1 * | 4/2015 | Matlin | B65H 3/22 241/30 |
| 2015/0343451 | A1 * | 12/2015 | Xu | B02C 23/00 241/34 |
| 2019/0358641 | A1 * | 11/2019 | Abe | B65H 1/14 |

* cited by examiner

PAPER SHREDDER WITH PAPER LIMITER

CROSS-REFERENCE TO RELATED APPLICATIONS

This application is related to, and claims priority to, both U.S. application Ser. No. 16/289,419, entitled "AUTOMATIC PAPER SHREDDER," filed 28 Feb. 2019, and U.S. application Ser. No. 16/289,524, entitled "AUTOMATIC PAPER SHREDDER WITH STAPLE REMOVING STRUCTURE AND STAPLE REMOVING METHOD USING SAME," filed 28 Feb. 2019, with the contents of both related applications being incorporated by reference herein in their entirety.

BACKGROUND OF THE INVENTION

1. Field of the Invention

The invention relates to the field of paper shredders, in particular to a paper shredder provided with a paper limiter.

2. Background Art

Paper shredders are composed of a set of rotary blades, a paper comb and a drive motor. Paper is fed between the mutually-engaged blades so as to be cut into numerous tiny paper scraps, thus, ensuring the confidentiality. As security equipment which has a security function and can keep modern office environments clean, paper shredders have become indispensable simple devices in offices.

An existing flip-type automatic paper shredder is provided with a paper pressing plate located on the inner side of an upper cover. The paper pressing plate is used for pressing paper placed in a paper tray to restraining the paper from moving, so that the paper pressing effect is effectively improved. However, a paper shredder provided with a height limit block and a paper limit block to limit the length and thickness of to-be-shredded paper stacked in the paper tray is presently not available.

SUMMARY

A paper shredder is provided having a paper tray, a paper inlet, a shredder cover, a paper pressing plate, paper pick-up rollers, a shredder cutter shaft, a motor, a wastepaper barrel, and a paper limiter. The paper tray is arranged on an upper portion of a shredder body and formed to carry a stack of to-be-shredded paper. The paper inlet is formed in the paper tray and guides the to-be-shredded paper into a shredding area. The shredder cover has an end rotatably connected to the shredder body by a rotary shaft and is configured for closing or opening the shredder body. The paper pressing plate is arranged below the shredder cover and presses the stack of to-be-shredded paper placed in the paper tray. The paper pick-up rollers arranged on one side of the paper inlet and feeds the stack of to-be-shredded paper placed in the paper tray towards the paper inlet. The shredder cutter shaft is arranged under the paper inlet and shreds the to-be-shredded paper guided into the shredding area. The motor is connected to the shredder cutter shaft and drives the shredder cutter shaft to operate. The wastepaper barrel is arranged in a lower portion of the shredder body and is located below the paper inlet to collect shredded paper. The paper limiter is arranged on an inner side of the paper tray and limits one of a thickness or a length of the stack of to-be-shredded paper placed in the paper tray.

In an embodiment, the paper limiter has a main paper limit block arranged on a side of the paper tray away from the rotary shaft, and a distance from a side of the main paper limit block proximate to the rotary shaft to a side of the paper tray proximate to the rotary shaft is approximately equal to the length of the to-be-shredded paper. In embodiments, the paper limiter further includes a main height limit block arranged on an inner side of an end of the paper tray proximate to the rotary shaft, and wherein the stack of to-be-shredded paper is clamped in the main height limit block when being placed into the paper tray so that the thickness of the stack of to-be-shredded paper is limited. In an embodiment, at least one main paper limit block is configured. When one main paper limit block is configured, the main paper limit block is in a middle of an inner side of an end of the paper tray away from the rotary shaft. When two or more main paper limit blocks are configured, the main paper limit blocks are uniformly arranged at intervals on the inner side of the end of the paper tray away from the rotary shaft.

In selected embodiments, the main paper limit block is an extendable structure used for limiting paper with different lengths in a length direction of the paper. In other embodiments, the main paper limit block is integrally formed with the paper tray.

The paper limiter further includes a plurality of main paper limit block vertical holes arrayed in parallel. The main paper limit block vertical holes are parallel to an inner side of an end of the paper tray away from the rotary shaft and allow the main paper limit block to be inserted therein to limit paper with different lengths. In embodiments in which at least one main height limit block is configured, the main height limit block is in a middle of the inner side of the end of the paper tray proximate to the rotary shaft. When two or more main height limit blocks are configured, the main height limit blocks are uniformly arranged at intervals on the inner side of the end of the paper tray proximate to the rotary shaft. In embodiments, the inner side formed with the main height limit block is provided with a plurality of main height limit block horizontal holes arrayed in parallel from top to bottom, and the main height limit block is inserted into at least one of the main height limit block horizontal holes to limit the paper in different heights.

In yet other embodiments, the paper limiter further includes a main height limit block fixing bracket, which is perpendicularly arranged on a bottom surface of the paper tray, is proximate to the inner side of the end of the paper tray proximate to the rotary shaft, and has an upper end in one of an U shape or an inverted T shape. A main height limit block vertical hole, matched with the upper end of the main height limit block fixing bracket in shape, is formed in a lower end face of the main height limit block. The main height limit block is clamped and connected to the main height limit block fixing bracket by the main height limit block vertical hole so that the stack of to-be-shredded paper is limited in thickness. In embodiments, the paper limiter further includes a main height limit block mounting bracket and two fastening screws, in which the main height limit block mounting bracket is fixed to a back of the inner side of the end of the paper tray proximate to the rotary shaft and is in a U shape. Two screw holes are formed in a side of the main height limit block facing the rotary shaft. A U-shaped groove is formed in a position of the paper tray opposite to the main height limit block mounting bracket and is narrower than the main height limit block mounting bracket. The two fastening screws penetrate through the main height limit block mounting bracket and the U-shaped groove to be fixedly connected to the main height limit block at a same height The two fastening screws can penetrate through the U-shaped groove at different heights to be fixedly connected to the main height limit block at the same height, so that the stack of to-be-shredded paper is limited in thickness. In embodiments, the paper limiter further includes an auxiliary height limit block arranged on a least one of a left side and a right side of the end of the paper tray proximate to the rotary shaft.

In selected embodiments, at least one of the main height limit blocks and the auxiliary height limit block is integrally formed with the paper tray. In yet other embodiments, the inner side formed with the auxiliary height limit block is provided from top to bottom with a plurality of auxiliary height limit block horizontal holes arrayed in parallel. The auxiliary height limit block is inserted into at least one of the auxiliary height limit block horizontal holes to limit the paper in different thicknesses. The main height limit block horizontal holes and the auxiliary height limit block hole horizontal holes are formed in approximately the same height. In still other embodiments, the paper limiter further includes an auxiliary height limit block fixing bracket, in which the auxiliary height limit block fixing bracket is perpendicularly arranged on a bottom surface of the paper tray, is proximate to a least one of the left side or the right side of the end of the paper tray proximate to the rotary shaft, and has an upper end in one of an U-shape or in an inverted T-shape. An auxiliary height limit block vertical hole, matched with the upper end of the auxiliary height limit block fixing bracket in shape, is formed in a lower end face of the auxiliary height limit block. The auxiliary height limit block is clamped and connected to the auxiliary height limit block fixing bracket via the auxiliary height limit block vertical hole so that the stack of to-be-shredded paper is limited in thickness. The paper pressing plate includes a friction plate, two paper pressing plate rollers, and two roller grooves. The two roller grooves are formed in the paper pressing plate in parallel and correspond to the paper pick-up rollers on the paper tray in position. The two paper pressing plate rollers penetrate through the roller grooves to extend onto the paper pressing plate and are matched with the paper pick-up rollers to feed the stack of to-be-shredded paper placed in the paper tray towards the paper inlet. The friction plate is arranged between the two roller grooves and is as wide as the roller grooves, and a length of the friction plate is equal to a distance between adjacent sides of the two roller grooves. The paper limiter further includes a main paper limit block and a main height limit block. The main paper limit block is arranged on a side of the paper tray proximate to the rotary shaft and a distance from a side of the main paper limit block away from the rotary shaft to a side of the paper tray away from the rotary shaft is equal to the length of the to-be-shredded paper. The main height limit block is arranged on an inner side of an end of the paper tray away from the rotary shaft, and the stack of to-be-shredded paper is clamped in the main height limit block when being placed into the paper tray.

Also provided herein is a paper shredder, having a paper tray arranged on an upper portion of a shredder body and formed to carry a stack of to-be-shredded paper; a paper inlet formed in the paper tray and guiding the to-be-shredded paper into a shredding area; a shredder cover having an end rotatably connected to the shredder body by a rotary shaft and configured for closing or opening the shredder body; a paper pressing plate arranged below the shredder cover and pressing the stack of to-be-shredded paper placed in the paper tray; paper pick-up rollers arranged on one side of the paper inlet and feeding the stack of to-be-shredded paper placed in the paper tray towards the paper inlet; a shredder cutter shaft arranged under the paper inlet and shredding the to-be-shredded paper guided into the shredding area; a motor connected to the shredder cutter shaft and driving the shredder cutter shaft to operate; a wastepaper barrel arranged in a lower portion of the shredder body and located below the paper inlet to collect shredded paper; and a paper limiter arranged on an inner side of the paper tray and limiting one of a thickness or a length of the stack of to-be-shredded paper placed in the paper tray. The paper limiter further includes at least one of a main paper limit block and a main height limit block, in which the main paper limit block is arranged on a side of the paper tray proximate to the rotary shaft and a distance from a side of the main paper limit block away from the rotary shaft to a side of the paper tray away from the rotary shaft is equal to the length of the to-be-shredded paper. The main height limit block is arranged on an inner side of an end of the paper tray away from the rotary shaft. The stack of to-be-shredded paper is clamped in the main height limit block when being placed into the paper tray.

The paper pressing plate includes a friction plate, two paper pressing plate rollers, and two roller grooves, in which the two roller grooves are formed in the paper pressing plate in parallel and correspond to the paper pick-up rollers on the paper tray in position. The two paper pressing plate rollers penetrate through the roller grooves to extend onto the paper pressing plate and are matched with the paper pick-up rollers to feed the stack of to-be-shredded paper placed in the paper tray towards the paper inlet. The friction plate is arranged between the two roller grooves and is as wide as the roller grooves, and a length of the friction plate is equal to a distance between adjacent sides of the two roller grooves.

BRIEF DESCRIPTION OF THE DRAWINGS

The foregoing and other aspects of the invention may be more fully understood from the following description, when read together with the accompanying drawings in which like reference numbers indicate like parts. Embodiments of the invention will now be described, by way of example, with reference to the accompanying drawings, in which.

Figure 1:
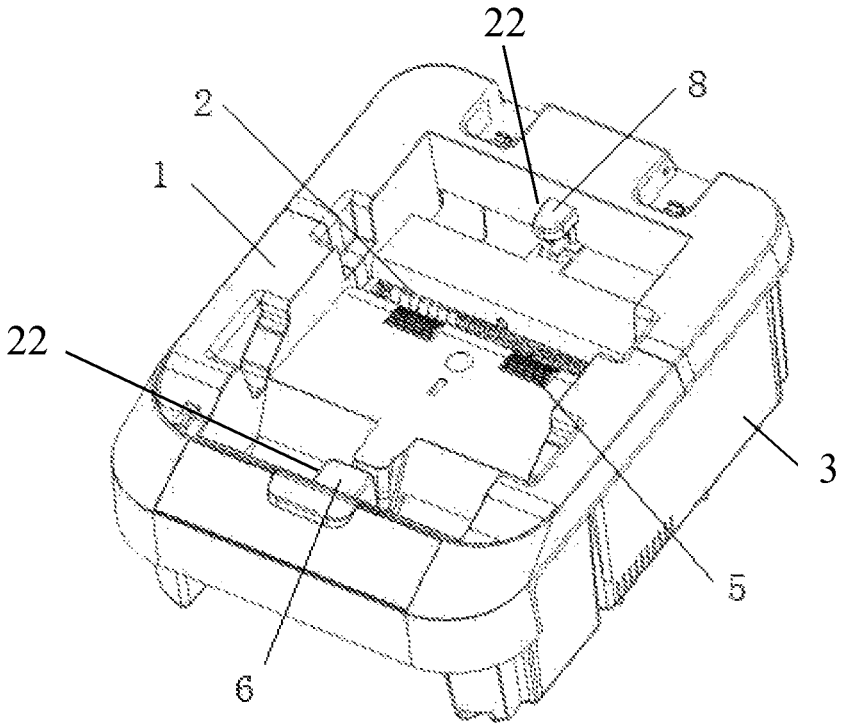
FIG. 1 is a first view of a first implementation of the overall structure of a paper shredder provided with a paper limiter, in accordance with the teachings of the present invention.
Figure 2:
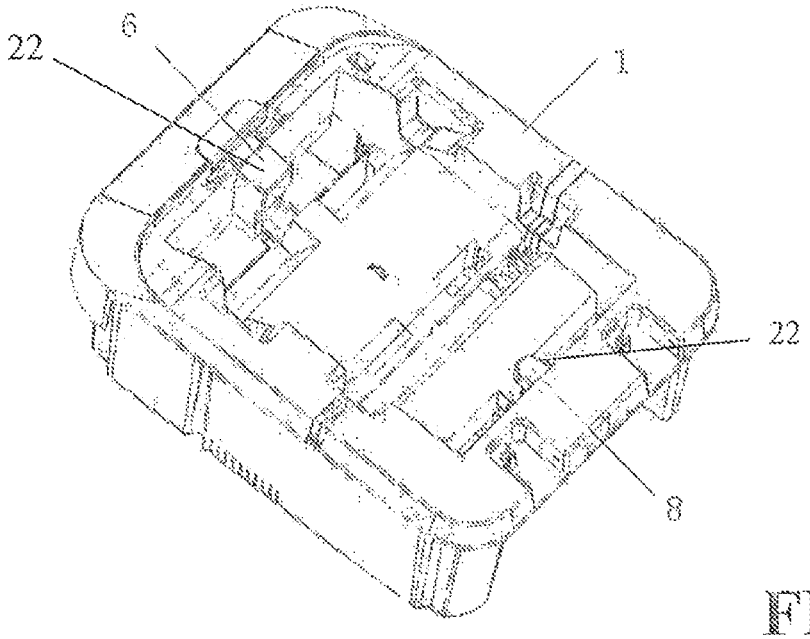
FIG. 2 is a second view of the first implementation of the overall structure of the paper shredder provided with a paper limiter, in accordance with the teachings of the present invention.

Some embodiments are described in detail with reference to the related drawings. Additional embodiments, features and/or advantages will become apparent from the ensuing description or may be learned by practicing the invention. In the FIGURES, which are not drawn to scale, like numerals refer to like features throughout the description. The following description is not to be taken in a limiting sense but is made merely for describing the general principles of the invention.

DETAILED DESCRIPTION OF THE INVENTION

The technical solutions provided by embodiments of the invention are clearly and completely described and discussed below with reference to the accompanying drawings. Clearly, the embodiments described below are only certain illustrative ones, and are not all possible ones of the invention. All other embodiments obtained by those ordinarily skilled in this field without creative labor based on these illustrative ones should also fall within the protection scope of the invention.

As shown in FIG. 1, FIG. 2, FIG. 11 and FIG. 14-17, a paper shredder with a paper limiter is shown and described. The paper shredder comprises shredder body 18, paper tray 1, paper inlet 2, shredder cover 3, rotary shaft 20, paper pressing plate 4, paper pick-up rollers 5, shredder cutter shaft 17, motor 16, wastepaper barrel 21, and paper limiter 22.

Paper tray 1 can be arranged on an upper portion of shredder body 18 and is used for carrying a stack of to-be-shredded paper (not shown). Paper inlet 2 is formed in paper tray 1 and is used for guiding the to-be-shredded paper into a shredding area (not shown). Shredder cover 3 has an end rotatably connected to shredder body 19 through rotary shaft 20 and is used for closing or opening shredder body 19. Paper pressing plate 4 is arranged below shredder cover 3 and is used for pressing the stack of to-be-shredded paper placed in paper tray 1. Paper pick-up rollers 5 are arranged on one side of paper inlet 2 and are used for feeding the stack of to-be-shredded paper placed in paper tray 1 towards paper inlet 2. Shredder cutter shaft 17 is arranged under paper inlet 2 and is used for shredding the to-be-shredded paper falling from paper inlet 2. Motor 16 is connected to shredder cutter shaft 17 and is used for driving shredder cutter shaft 17. Wastepaper barrel 21 is arranged in the lower portion of shredder body and is located below paper inlet 2 to collect shredded paper. Paper limiter 22 can be arranged on an inner side of paper tray 1 and is used for limiting the thickness, length, or both, of the stack of to-be-shredded paper placed in paper tray 1. Paper limiter 22 can include one or more of main paper limit block 6, auxiliary paper limit block 23, main height limit block 8, or auxiliary height limit block 12.

Figure 3:
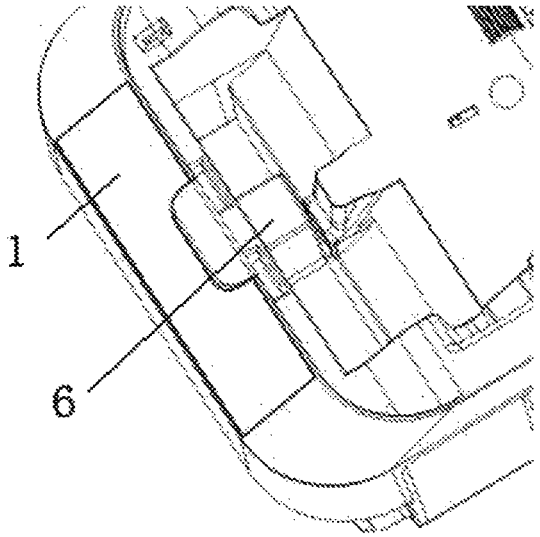
FIG. 3 is an enlarged view of a main paper limit block of the paper shredder provided with a paper limiter, in accordance with the teachings of the present invention.

In an embodiment, as shown in FIG. 1 and FIG. 3, paper limiter 22 can include main paper limit block 6, arranged on a side of paper tray 1 away from rotary shaft 20. The distance from a side of main paper limit block 6 proximate to the rotary shaft, to a side of paper tray 1 also proximate to the rotary shaft can be equal to the length of the to-be-shredded paper. Furthermore, paper limiter 22 can be configured with one, two or more main paper limit blocks 6. When one main paper limit block 6 is configured, main paper limit block 6 is in the middle of the inner side of an end of paper tray 1, away from rotary shaft 20. Alternately, when two or more main paper limit blocks 6 are configured, main paper limit blocks 6 can be uniformly arranged at intervals on the inner side of the end of paper tray 1 away from the rotary shaft. Also, main paper limit blocks 6 can be centralized in the middle of the inner side of the end of paper tray 1, away from the rotary shaft.

Figure 4:
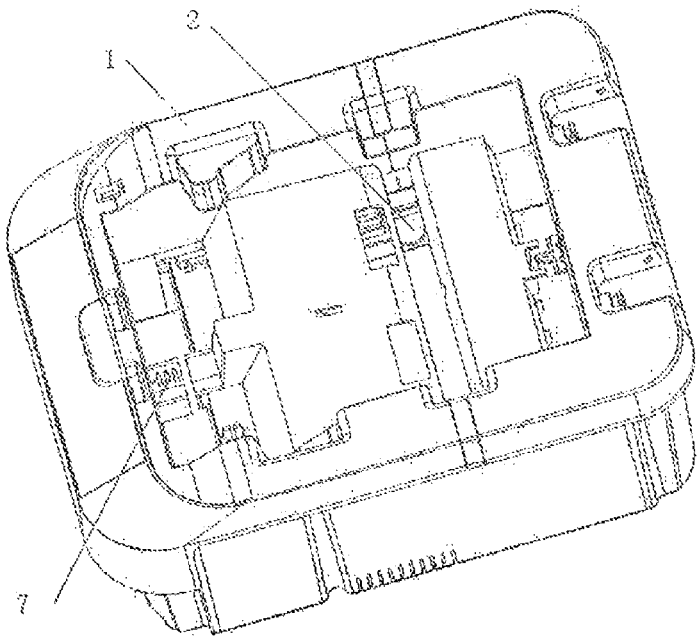
FIG. 4 is a schematic diagram of main paper limit block vertical holes of the paper shredder provided with a paper limiter, in accordance with the teachings of the present invention.

In an embodiment, main paper limit block 6 used for limiting the stack of to-be-shredded paper in length can be a fixed or a non-fixed structure, particularly:

when main paper limit block 6 is a fixed structure, main paper limit block 6 is integrally formed with paper tray 1; and when main paper limit block 6 is a non-fixed structure, main paper limit block 6 is extendable and can be used for limiting paper with different lengths in the length direction of the paper. Paper limiter 22 may further include a plurality of main paper limit block vertical holes 7. As shown in FIG. 4, main paper limit block vertical holes 7 are arrayed in parallel, are parallel to the inner side of the end away from the rotary shaft of paper tray 1. Main paper limit block vertical holes 7 allow main paper limit block 6 to be inserted therein to limit paper with different lengths, and thus, the positioning of paper with different lengths is achieved.

Figure 10:
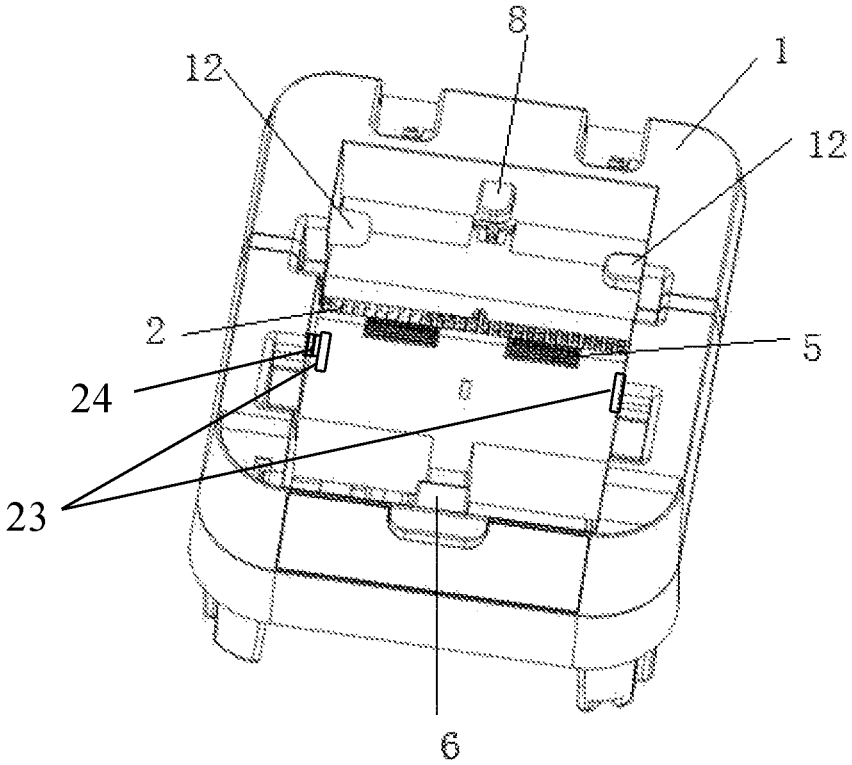
FIG. 10 is a structure diagram of auxiliary height limit blocks arranged on two sides of the paper shredder provided with a paper limiter, in accordance with the teachings of the present invention.

In addition, as can be seen in FIG. 10, paper limiter 22 may further include auxiliary paper limit block 23, which may be arranged on at least one of the left side and the right side of the end of paper tray 1, proximate to main paper limit block 6. Auxiliary paper limit block 23 can be used for limiting paper with different widths in the width direction of the paper, so that the paper shredder can adapt to paper with different widths. Auxiliary paper limit blocks 23 may be symmetrically arranged on the left side and the right side of the end and may be proximate to main paper limit block 6 of paper tray 1.

Auxiliary paper limit block 23, used for limiting the stack of to-be-shredded paper in width, can be a fixed or a non-fixed structure, particularly:

when auxiliary paper limit block 23 is a fixed structure, auxiliary paper limit block 23 can be integrally formed with paper tray 1; and when auxiliary paper limit block 23 is a non-fixed structure, auxiliary paper limit block 23 can be extendable and can be used for limiting paper with different widths in the width direction of the paper. Also, paper limiter 22 further includes a plurality of auxiliary paper limit block vertical holes 24, wherein auxiliary paper limit block vertical holes 24 are arrayed in parallel, are parallel to least one of the left side and the right side of the end of paper tray 1, are proximate to main paper limit block 6, and can allow auxiliary paper limit block 23 to be inserted therein so as to limit paper with different widths, and thus, the positioning of paper with different widths is achieved.

Figure 5:
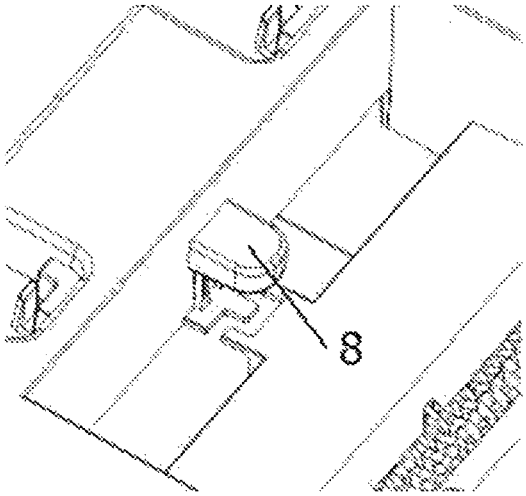
FIG. 5 is an enlarged view of a main height limit block of the paper shredder provided with a paper limiter, in accordance with the teachings of the present invention.

In an embodiment, as shown in FIG. 1 and FIG. 5, paper limiter 22 further includes main height limit block 8, wherein main height limit block 8 is arranged on the inner side of an end of paper tray 1, proximate to the rotary shaft. Typically, the stack of to-be-shredded paper is clamped in main height limit block 8 when being placed into the paper tray by users, so that the thickness of the stack of to-be-shredded paper is limited. Through the design of main height limit block 8, users can place a proper quantity of paper into paper tray 1, and the situation where too much paper is placed into the paper tray and cannot be firmly pressed may be avoided.

Furthermore, one, two or more main height limit blocks 8 can be configured. When one main height limit block 8 is configured, main height limit block 8 can be in the middle of the inner side of the end of paper tray 1 proximate to the rotary shaft. Alternately, when two or more main height limit blocks 8 are configured, main height limit blocks 8 are uniformly arranged at intervals on the inner side of the end of paper tray 1, proximate to the rotary shaft. Also, the main height limit blocks 8 can be centralized in the middle of the inner side of the end of paper tray 1 proximate to the rotary shaft.

Figure 6:
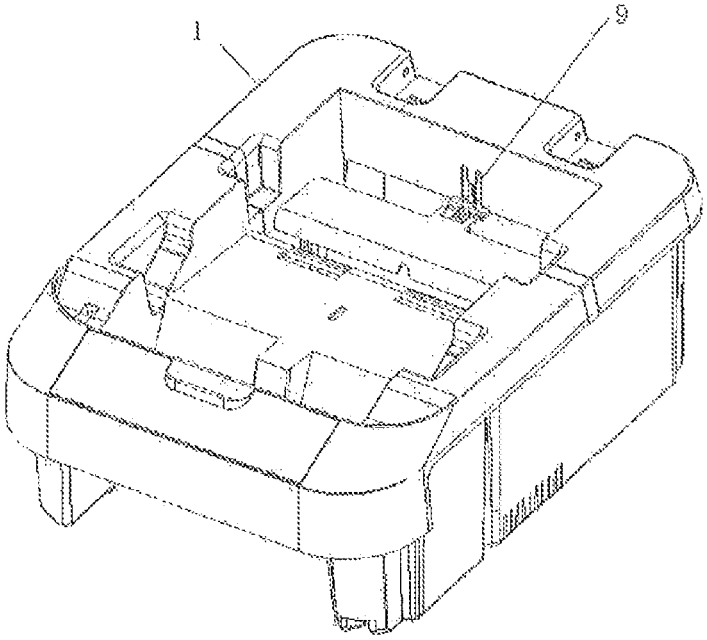
FIG. 6 is a schematic diagram of a main height limit block fixing bracket of the paper shredder provided with a paper limiter, in accordance with the teachings of the present invention.
Figure 7:
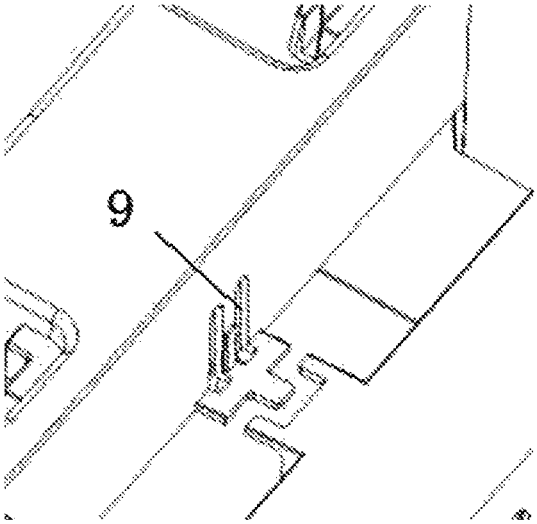
FIG. 7 is an enlarged view of the main height limit block fixing bracket of the paper shredder provided with a paper limiter, in accordance with the teachings of the present invention.

In this embodiment, main height limit block 8 used for limiting the stack of to-be-shredded paper in height can be of a fixed or non-fixed structure, particularly:

when main height limit block 8 is a fixed structure, main height limit block 8 is integrally formed with paper tray 1; and when main height limit block 8 is a non-fixed structure, there are the following three exemplary cases:

In case 1, the inner side formed with main height limit block 8 is provided with a plurality of main height limit block horizontal holes arrayed in parallel from top to bottom. Main height limit block 8 can be inserted into at least one of the main height limit block horizontal holes to limit paper in different heights In case 2, as shown in FIG. 6 and FIG. 7, paper limiter 22 can further include main height limit block fixing bracket 9, which can be perpendicularly arranged on the bottom surface of paper tray 1, and can be proximate to the inner side of the end of paper tray 1 proximate to the rotary shaft 20. Main height limit block fixing bracket 9 can have an upper end in a U-shape, or in an inverted T-shape. Main height limit block vertical hole (not shown) can be matched with the upper end of the main height limit block fixing bracket 9 can be formed in the lower end face of main height limit block 8. Main height limit block 8 can be clamped and connected to the main height limit block fixing bracket 9 via a main height limit block vertical hole, so that the to-be-shredded paper is limited in height.

Figure 8:
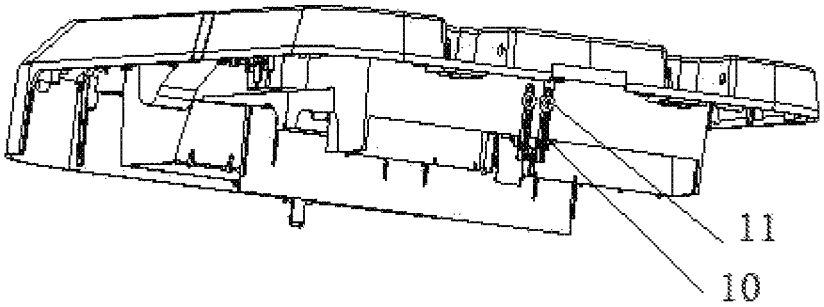
FIG. 8 is a location diagram of the main height limit block of the paper shredder provided with a paper limiter, in accordance with the teachings of the present invention.

In case 3, as shown in FIG. 8, paper limiter 22 further includes main height limit block mounting bracket 10 and two fastening screws 11. Main height limit block mounting bracket 10 is fixed to the back of the inner side of the end of paper tray 1, proximate to rotary shaft 20, and is in a U-shape. Two screw holes (not shown) can be formed in a side, facing the rotary shaft, of main height limit block 8. A U-shaped groove (not shown) is formed in a position, opposite to the main height limit block mounting bracket 10 of paper tray 1 and is narrower than the main height limit block mounting bracket 10. Two fastening screws 11 penetrate through main height limit block mounting bracket 10 and fixedly connect the U-shaped groove to main height limit block 8 at generally the same height. Two fastening screws 11 can penetrate through the U-shaped grooves at different heights to be fixedly connected to main height limit block 8 at the same height, so that the to-be-shredded paper is limited in height. In other embodiments, the U-shaped groove can be replaced with a 11-shaped groove, and correspondingly, the main height limit block mounting bracket 10 can be disposed in a 11-shaped arrangement, so that the same effect is achieved.

Figure 9:
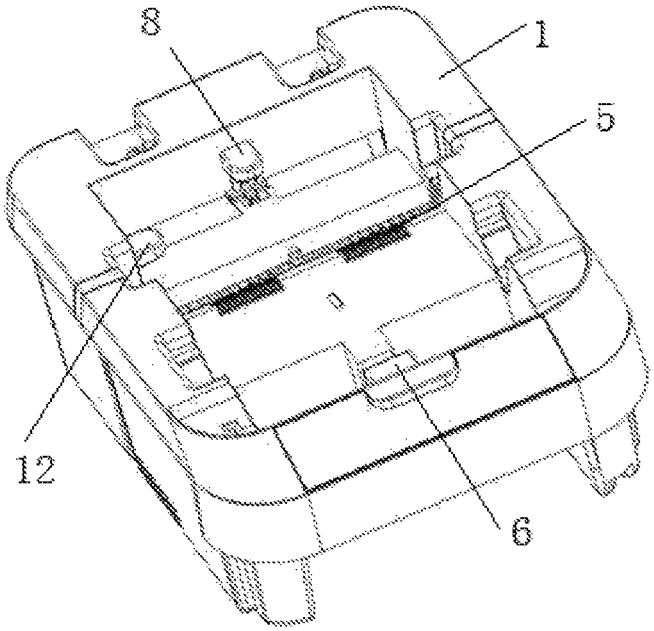
FIG. 9 is a structure diagram of an auxiliary height limit block arranged on one side of the paper shredder provided with a paper limiter, in accordance with the teachings of the present invention.

In addition, as shown in FIG. 9 and FIG. 10, paper limiter 22 further includes an auxiliary height limit block 12, wherein the auxiliary height limit block 12 is arranged on a least one of the left side and the right side of the end, proximate to the rotary shaft, of paper tray 1. In an embodiment, auxiliary height limit blocks 12 are symmetrically arranged on the left side and the right side.

Auxiliary height limit block 12 used for limiting the stack of to-be-shredded paper in height can be a fixed or a non-fixed structure, particularly:

when the auxiliary height limit block 12 is a fixed structure, the auxiliary height limit block 12 is integrally formed with paper tray 1 when the auxiliary height limit block 12 is a non-fixed structure, there are the following several cases:

In case 1, the inner side formed with the auxiliary height limit block 12 is provided with a plurality of auxiliary height limit block horizontal holes (not shown) in parallel, from top to bottom. Auxiliary height limit block 12 can be inserted into at least one of the auxiliary height limit block horizontal holes, so that paper is limited in different heights. In an embodiment, the main height limit block horizontal holes and the auxiliary height limit block horizontal holes are formed at the same height.

In case 2, paper limiter 22 further includes an auxiliary height limit block fixing bracket (not shown), wherein the auxiliary height limit block fixing bracket is perpendicularly arranged on the bottom surface of paper tray 1, is proximate to a least one of the left side and the right side of the end, proximate to the rotary shaft, of paper tray 1 and has an upper end in a U shape or in an inverted T shape and an auxiliary height limit block vertical hole (not shown) matched with the upper end of the auxiliary height limit block fixing bracket in shape is formed in the lower end face of the auxiliary height limit block 12, and the auxiliary height limit block 12 is clamped and connected to the auxiliary height limit block fixing bracket via the auxiliary height limit block vertical hole, so that the stack of the to-be-shredded paper is limited in height. In this embodiment, the distance from the lower end faces of main height limit block 8 and the auxiliary height limit block 12 to the bottom surface of paper tray 1 is not greater than the distance from the upper end faces of main paper limit block 6 and the auxiliary paper limit block to the bottom surface of paper tray 1.

Figure 11:
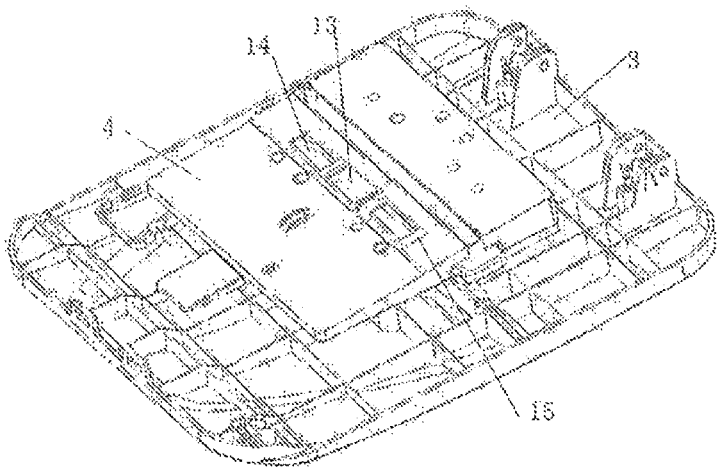
FIG. 11 is a structure diagram of a paper pressing plate of the paper shredder provided with a paper limiter, in accordance with the teachings of the present invention.
Figure 12:
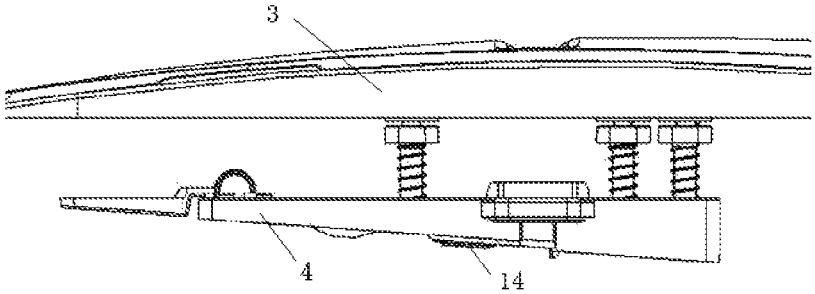
FIG. 12 is a side view of the paper pressing plate of the paper shredder provided with a paper limiter, in accordance with the teachings of the present invention.

In another embodiment, as shown in FIG. 11 and FIG. 12, the paper pressing plate 4 comprises a friction plate 13, two paper pressing plate rollers 14, and two roller grooves 15. In general, two roller grooves 15 are formed in the paper pressing plate 4 in parallel and correspond to the paper pick-up rollers 5 on paper tray 1. In position, the two paper pressing plate rollers 14 penetrate through the two roller grooves 15 to extend onto the paper pressing plate 4 and are matched with the paper pick-up rollers 15 to feed the stack of to-be-shredded paper placed in paper tray 1 towards paper inlet 2. Friction plate 13 is arranged between two roller grooves 15 and can be as wide as each of roller grooves 15. The length of friction plate 13 can be equal to the distance between adjacent sides of the two roller grooves 15. The design of friction plate 13 effectively enlarges the contact area of the last 2-5 pieces of paper in the stack of to-be-shredded paper with the paper pick-up rollers 5, so that the success rate of paper feeding is greatly increased.

Figure 13:
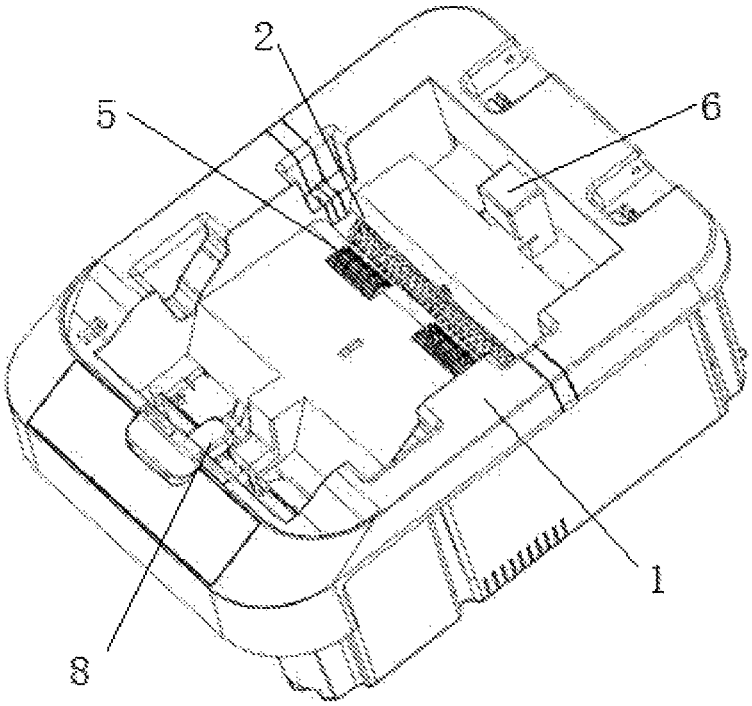
FIG. 13 is a structure diagram of a second implementation of the overall structure of the paper shredder provided with a paper limiter, in accordance with the teachings of the present invention.
Figure 14:
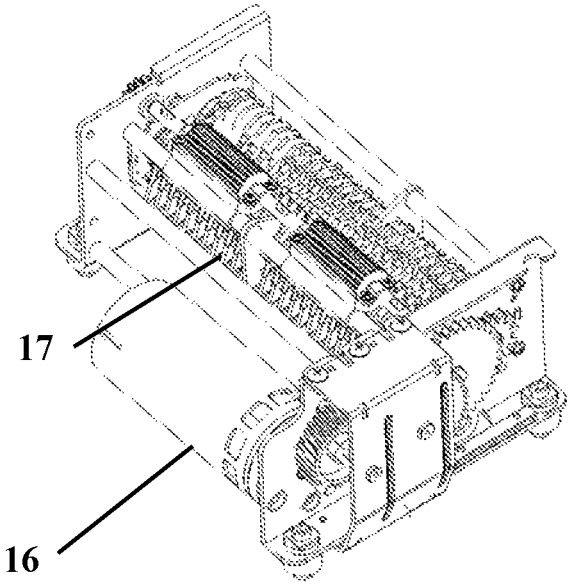
FIG. 14 is a structure diagram of a shredding mechanism, in accordance with the teachings of the present invention.
Figure 15:
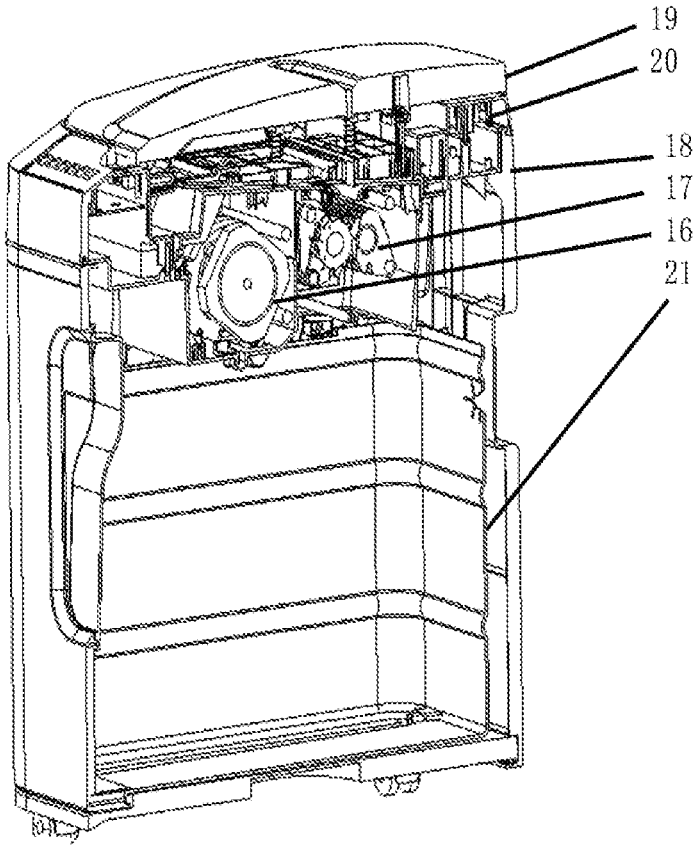
FIG. 15 is a longitudinal cross-section of a shredder, in accordance with the teachings of the present invention.
Figure 16:
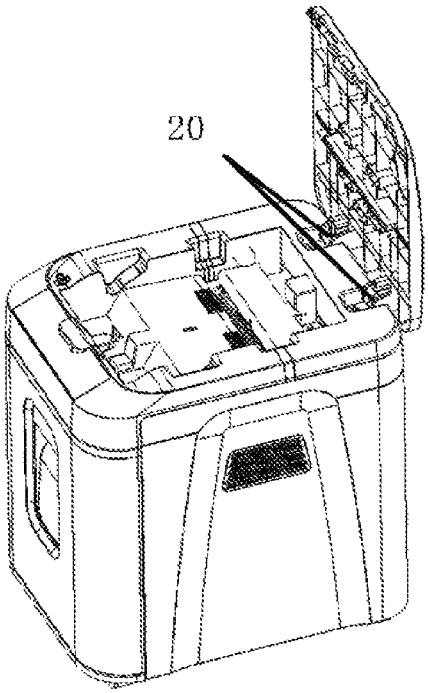
FIG. 16 is a structure diagram of a paper shredder, in accordance with the teachings of the present invention.
Figure 17:
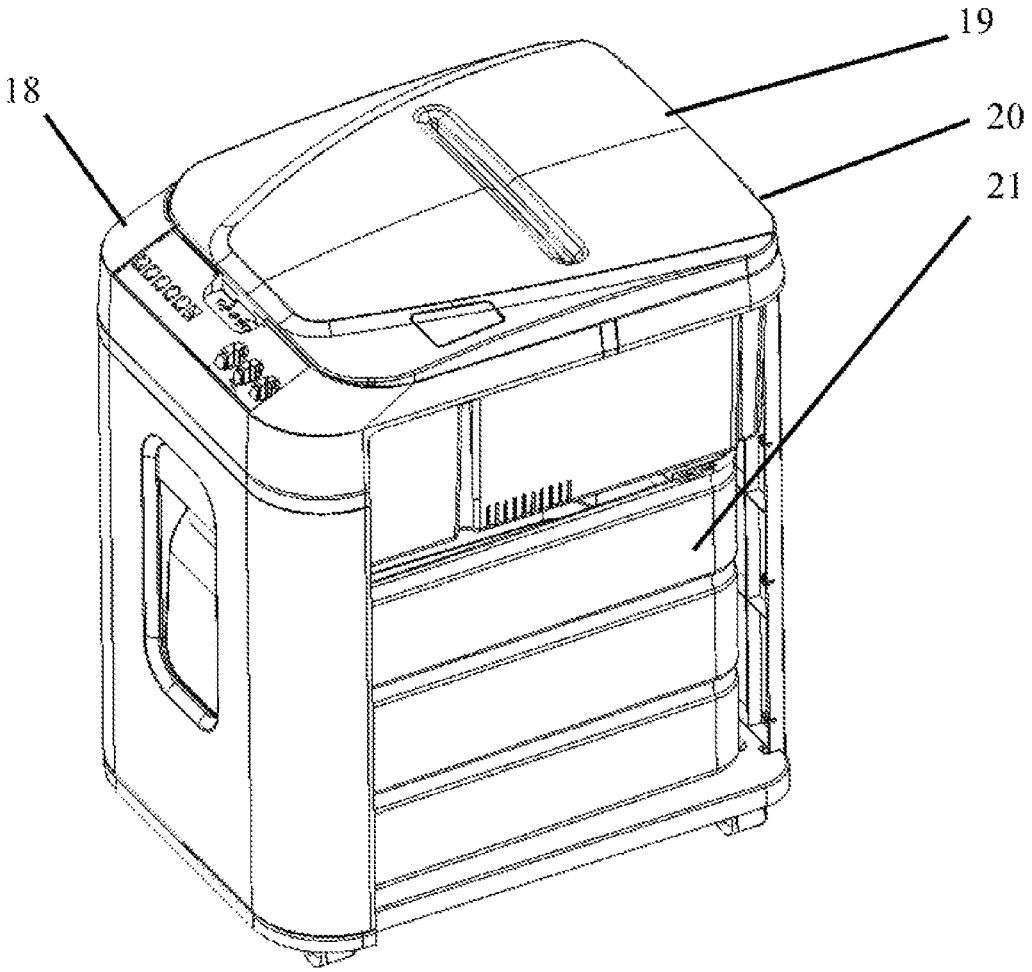
FIG. 17 is a structure diagram of a paper shredder, in accordance with the teachings of the present invention.

In a variation of this embodiment, the position of main paper limit block 6 and the position of main height limit block 8 of paper limiter 22 are exchanged, compared with main paper limit block 6 and main height limit block 8 shown in FIG. 1. Particularly, main paper limit block 6 can be arranged on the side of paper tray 1 proximate to rotary shaft 20. The distance from the side of main paper limit block 6 away from rotary shaft 20, to the side of paper tray 1 away from rotary shaft 20, may be the same as the length of the to-be-shredded paper. Main height limit block 8 can be arranged on the inner side of the end of paper tray 1, away from rotary shaft 20. The stack of to-be-shredded paper is clamped in main height limit block 8 when being placed into paper tray 1. Although paper limiter 22 shown in FIG. 13 might not be operated as conveniently as paper limiter 22 shown in FIG. 1, in practical use when users place the stack of to-be-shredded paper into the paper tray, this paper limiter can also limit the stack of paper in length and in thickness.

The above embodiments are not intended to limit the protection scope of the invention. Any changes or substitutes easily achievable for any skilled artisan in this technical field, based on the technical solutions disclosed above, should also fall within the protection scope of the invention. Thus, the protection scope of the invention should be subject to the protection scope defined by the claims.

What is claimed is:

1. A paper shredder, comprising:

a paper tray arranged on an upper portion of a shredder body and formed to carry a stack of to-be-shredded paper;

a paper inlet formed in the paper tray and guiding the to-be-shredded paper into a shredding area;

a shredder cover having an end rotatably connected to the shredder body by a rotary shaft and configured for closing or opening the shredder body;

a paper pressing plate arranged below the shredder cover and pressing the stack of to-be-shredded paper placed in the paper tray;

paper pick-up rollers arranged on one side of the paper inlet and feeding the stack of to-be-shredded paper placed in the paper tray towards the paper inlet;

a shredder cutter shaft arranged under the paper inlet and shredding the to-be-shredded paper guided into the shredding area;

a motor connected to the shredder cutter shaft and driving the shredder cutter shaft to operate;

a wastepaper barrel arranged in a lower portion of the shredder body and located below the paper inlet to collect shredded paper; and a paper limiter arranged on an inner side of the paper tray and limiting one of a thickness or a length of the stack of to-be-shredded paper placed in the paper tray wherein the paper limiter further comprises a main paper limit block; and a main height limit block, wherein the main paper limit block is arranged on a side of the paper tray proximate to the rotary shaft and a distance from a side of the main paper limit block away from the rotary shaft to a side of the paper tray away from the rotary shaft is equal to the length of the to-be-shredded paper, and wherein the main height limit block is arranged on an inner side of an end of the paper tray away from the rotary shaft, and wherein the stack of to-be-shredded paper is clamped in the main height limit block when being placed into the paper tray.

2. The paper shredder according to claim 1, wherein the paper limiter comprises a main paper limit block arranged on a side of the paper tray away from the rotary shaft, and a distance from a side of the main paper limit block proximate to the rotary shaft to a side of the paper tray proximate to the rotary shaft is approximately equal to the length of the to-be-shredded paper.

3. The paper shredder according to claim 2, wherein at least one main paper limit block is configured, and wherein:

when one main paper limit block is configured, the main paper limit block is in a middle of an inner side of an end of the paper tray away from the rotary shaft, or when two or more main paper limit blocks are configured, the main paper limit blocks are uniformly arranged at intervals on the inner side of the end of the paper tray away from the rotary shaft.

4. The paper shredder according to claim 2, wherein the main paper limit block is an extendable structure used for limiting paper with different lengths in a length direction of the paper.

5. The paper shredder according to claim 2, wherein the paper limiter further comprises a plurality of main paper limit block vertical holes arrayed in parallel, are parallel to an inner side of an end of the paper tray away from the rotary shaft, and allow the main paper limit block to be inserted therein so as to limit paper with different lengths.

6. The paper shredder according to claim 2, wherein the main paper limit block is integrally formed with the paper tray.

7. The paper shredder according to claim 1, wherein the paper limiter further comprises a main height limit block arranged on an inner side of an end of the paper tray proximate to the rotary shaft, and wherein the stack of to-be-shredded paper is clamped in the main height limit block when being placed into the paper tray so that the thickness of the stack of to-be-shredded paper is limited.

8. The paper shredder according to claim 7, wherein at least one main height limit block is configured, wherein:

when one main height limit block is configured, the main height limit block is in a middle of the inner side of the end of the paper tray proximate to the rotary shaft; or when two or more said main height limit blocks are configured, the main height limit blocks are uniformly arranged at intervals on the inner side of the end of the paper tray proximate to the rotary shaft.

9. The paper shredder according to claim 8, wherein the inner side formed with the main height limit block is provided with a plurality of main height limit block horizontal holes arrayed in parallel from top to bottom, and the main height limit block is inserted into at least one of the main height limit block horizontal holes to limit the paper in different heights.

10. The paper shredder provided with a paper limiter according to claim 7, wherein the paper limiter further comprises a main height limit block fixing bracket, wherein the main height limit block fixing bracket is perpendicularly arranged on a bottom surface of the paper tray, is proximate to the inner side of the end of the paper tray proximate to the rotary shaft, and has an upper end in one of an U shape or an inverted T shape, wherein a main height limit block vertical hole matched with the upper end of the main height limit block fixing bracket in shape is formed in a lower end face of the main height limit block, and the main height limit block is clamped and connected to the main height limit block fixing bracket by the main height limit block vertical hole so that the stack of to-be-shredded paper is limited in thickness.

11. The paper shredder according to claim 7, wherein the paper limiter further comprises:

a main height limit block mounting bracket and two fastening screws, wherein the main height limit block mounting bracket is fixed to a back of the inner side of the end of the paper tray proximate to the rotary shaft and is in a U shape, wherein two screw holes are formed in a side of the main height limit block facing the rotary shaft, wherein a U-shaped groove is formed in a position of the paper tray opposite to the main height limit block mounting bracket and is narrower than the main height limit block mounting bracket, wherein the two fastening screws penetrate through the main height limit block mounting bracket and the U-shaped groove to be fixedly connected to the main height limit block at a same height, and wherein the two fastening screws can penetrate through the U-shaped groove at different heights to be fixedly connected to the main height limit block at the same height, so that the stack of to-be-shredded paper is limited in thickness.

12. The paper shredder according to claim 9, wherein the paper limiter further comprises an auxiliary height limit block arranged on a least one of a left side and a right side of the end of the paper tray proximate to the rotary shaft.

13. The paper shredder according to claim 12, wherein at least one of the main height limit block and the auxiliary height limit block is integrally formed with the paper tray.

14. The paper shredder according to claim 12, wherein the inner side formed with the auxiliary height limit block is provided from top to bottom with a plurality of auxiliary height limit block horizontal holes arrayed in parallel, and wherein the auxiliary height limit block is inserted into at least one of the auxiliary height limit block horizontal holes to limit the paper in different thicknesses.

15. The paper shredder according to claim 14, wherein the main height limit block horizontal holes and the auxiliary height limit block hole horizontal holes are formed in approximately the same height.

16. The paper shredder according to claim 12, wherein the paper limiter further comprises an auxiliary height limit block fixing bracket, wherein the auxiliary height limit block fixing bracket is perpendicularly arranged on a bottom surface of the paper tray, is proximate to a least one of the left side or the right side of the end of the paper tray proximate to the rotary shaft, and has an upper end in one of an U-shape or in an inverted T-shape, wherein an auxiliary height limit block vertical hole matched with the upper end of the auxiliary height limit block fixing bracket in shape is formed in a lower end face of the auxiliary height limit block, and wherein the auxiliary height limit block is clamped and connected to the auxiliary height limit block fixing bracket via the auxiliary height limit block vertical hole so that the stack of to-be-shredded paper is limited in thickness.

17. The paper shredder according to claim 1, wherein the paper pressing plate comprises:

a friction plate;

two paper pressing plate rollers; and two roller grooves, wherein the two roller grooves are formed in the paper pressing plate in parallel and correspond to the paper pick-up rollers on the paper tray in position, wherein the two paper pressing plate rollers penetrate through the roller grooves to extend onto the paper pressing plate and are matched with the paper pick-up rollers to feed the stack of to-be-shredded paper placed in the paper tray towards the paper inlet, and wherein the friction plate is arranged between the two roller grooves and is as wide as the roller grooves, and a length of the friction plate is equal to a distance between adjacent sides of the two roller grooves.

18. A paper shredder, comprising:

a paper tray arranged on an upper portion of a shredder body and formed to carry a stack of to-be-shredded paper;

a paper inlet formed in the paper tray and guiding the to-be-shredded paper into a shredding area;

a shredder cover having an end rotatably connected to the shredder body by a rotary shaft and configured for closing or opening the shredder body;

a paper pressing plate arranged below the shredder cover and pressing the stack of to-be-shredded paper placed in the paper tray;

paper pick-up rollers arranged on one side of the paper inlet and feeding the stack of to-be-shredded paper placed in the paper tray towards the paper inlet;

a shredder cutter shaft arranged under the paper inlet and shredding the to-be-shredded paper guided into the shredding area;

a motor connected to the shredder cutter shaft and driving the shredder cutter shaft to operate;

a wastepaper barrel arranged in a lower portion of the shredder body and located below the paper inlet to collect shredded paper; and a paper limiter arranged on an inner side of the paper tray and limiting one of a thickness or a length of the stack of to-be-shredded paper placed in the paper tray, wherein the paper limiter further includes at least one of:

a main paper limit block, or a main height limit block, wherein the main paper limit block is arranged on a side of the paper tray proximate to the rotary shaft and a distance from a side of the main paper limit block away from the rotary shaft to a side of the paper tray away from the rotary shaft is equal to the length of the to-be-shredded paper, wherein the main height limit block is arranged on an inner side of an end of the paper tray away from the rotary shaft, wherein the stack of to-be-shredded paper is clamped in the main height limit block when being placed into the paper tray, wherein the paper pressing plate includes a friction plate, two paper pressing plate rollers, and two roller grooves, wherein the two roller grooves are formed in the paper pressing plate in parallel and correspond to the paper pick-up rollers on the paper tray in position, wherein the two paper pressing plate rollers penetrate through the roller grooves to extend onto the paper pressing plate and are matched with the paper pick-up rollers to feed the stack of to-be-shredded paper placed in the paper tray towards the paper inlet, and wherein the friction plate is arranged between the two roller grooves and is as wide as the roller grooves, and a length of the friction plate is equal to a distance between adjacent sides of the two roller grooves.

* * * * *